US006579429B2

(12) United States Patent
Inagaki et al.

(10) Patent No.: US 6,579,429 B2
(45) Date of Patent: Jun. 17, 2003

(54) ANTIFOULING SYSTEM FOR STRUCTURE EXPOSED TO SEAWATER AND HEAT EXCHANGER

(75) Inventors: Shuichi Inagaki, Yokosuka (JP); Shigeru Sakurada, Kisarazu (JP); Shoji Nakashima, Yokohama (JP); Tadahiko Ooba, Tokyo (JP)

(73) Assignees: Kabushiki Kaisha Toshiba, Tokyo (JP); Nakabohtec Corrosion Protecting Co., Ltd., Tokyo (JP)

( * ) Notice: Subject to any disclaimer, the term of this patent is extended or adjusted under 35 U.S.C. 154(b) by 0 days.

(21) Appl. No.: 09/995,806

(22) Filed: Nov. 29, 2001

(65) Prior Publication Data

US 2002/0108849 A1 Aug. 15, 2002

(30) Foreign Application Priority Data

Nov. 29, 2000 (JP) ..... 2000-362991

(51) Int. Cl.[7] ..... C23F 13/00

(52) U.S. Cl. ..... 204/196.02; 204/196.01; 204/196.03; 204/196.37

(58) Field of Search ..... 204/196.01, 196.02, 204/196.03, 196.37; 205/734, 738, 740

(56) References Cited

U.S. PATENT DOCUMENTS

| | | | |
|---|---|---|---|
| 4,256,556 A | 3/1981 | Bennett et al. | |
| 6,511,586 B1 * | 1/2003 | Nakashima et al. | 204/196.01 |

FOREIGN PATENT DOCUMENTS

| | | |
|---|---|---|
| JP | 1-46595 | 10/1989 |
| JP | 10-271942 | 10/1998 |
| JP | 2000-119884 | 4/2000 |

* cited by examiner

*Primary Examiner*—Bruce F. Bell
(74) *Attorney, Agent, or Firm*—Foley & Lardner

(57) ABSTRACT

A titanium sheet (4) serving as an anode-forming member is fixed on a tube plate (1*a*) of a heat exchanger (1) via a insulting sheet (5) and an insulating adhesive (6). The sheet (4) is coated with a film (3) of an electrochemically active, stable electrical catalyst. A dc power unit (7) has a positive electrode (7*a*) electrically connected to the sheet (4), and a negative electrode (7*b*) electrically connected to the tubes (1*b*). The inner surfaces of the tubes (1*b*) are used as a cathode for electrolysis for oxygen generation. An automatic potential controller (7*c*) adjusts potential difference between the electrodes (7*a*, 7*b*) such that oxygen is generated in seawater while generation of chlorine in seawater is suppressed. An external dc power unit (40) and a cathodic protection electrode (41) supply a cathodic protection current to the tubes (1*b*).

12 Claims, 6 Drawing Sheets

ANTIFOULING SYSTEM FOR STRUCTURE EXPOSED TO SEAWATER AND HEAT EXCHANGER

BACKGROUND OF THE INVENTION

1. Field of the Invention

The present invention relates to an antifouling system for preventing marine organisms from attaching themselves to surfaces exposed to seawater of a structure exposed to seawater. More particularly, the present invention relates to an antifouling system including an electrical catalyst coat formed on a surface, exposed to seawater, of a structure, and capable of generating oxygen to prevent marine organisms from attaching themselves to the surface.

2. Description of the Related Art

Mussels, barnacles, hydrozoan and the like (hereinafter, referred to inclusively as "marine organisms") attach themselves to the inlet and the outlet tube plate supporting heat transfer tubes of a heat exchanger installed in a power plant using seawater as cooling water. These marine organisms clog end parts of the heat transfer tubes to obstruct the insertion of cleaning swabs in the heat transfer tubes and/or cover the inner surface of the heat transfer tubes. Therefore, the power plant is unavoidably subject to frequent shutdown for work to remove the marine organisms from the heat transfer tubes. Those marine organisms are more likely to attach themselves to titanium tube plates and titanium heat transfer tubes, which are corrosion resistant in seawater, than to attach themselves to tube plates and heat transfer pipes which are made of copper alloys.

Larval marine organisms pass through a strainer to penetrate into a rubber-lined steel water box of the heat exchanger. They adhere to the rubber-liner of the steel water box, grow thereon, and fall off therefrom. This result in clogging of heat transfer tubes.

For the purpose of exterminating those marine organisms and preventing marine organisms from attaching themselves to the tubes (i.e., "antifouling"), various measures are taken. Such measures include: pouring chlorine or a chlorine compound into environmental seawater; coating surfaces exposed to seawater with an antifouling paint containing a toxic ion generating pigment; and generating toxic ions, such as chlorine ions or copper ions, through the electrolysis of seawater.

Although these measures exercise effective antifouling functions, the management of the quantity and concentration of those chemicals is not simple when dealing with quantities of seawater and, therefore, the chemical concentration of seawater is liable to be excessively large. Consequently, it is highly possible that the seawater containing an antifouling chemical causes environmental contamination. Thus, there is a trend in recent years to inhibit or control the use of the aforesaid methods.

Recently, many researchers and technicians are engaged in research-and-development activities to develop safe antifouling measures which will not cause environmental pollution. For example, antifouling silicone paints are nontoxic and do not cause environmental pollution. However, collision of shells and foreign substances with the silicone paints shortens the effective antifouling life of the silicone paints. Coating work using antifouling silicone paints requires a high cost. Antifouling silicone paints cannot be applied to structures having large surfaces and existing structures by simple, easy coating work. The antifouling effect of antifouling silicone paints is reduced in still seawater. Due to the above disadvantages, antifouling silicone paints have not been prevalently applied to practical uses.

JP-B (Kokoku) No. Hei 01-46595 discloses another antifouling method. In this method, a film of an electrical catalyst, such as a mixed crystal of platinum group metals or a mixture of such a mixed crystal and oxides of such platinum group metals, is formed on the surfaces of structural members. Water or seawater is electrolyzed using the electrical catalyst as an anode to generate sufficient oxygen substantially without producing chlorine gas in order that the adhesion of organisms living in water to and the deposition of scales on the surfaces of the structural members are suppressed.

However, in this known antifouling method, the electrical catalyst is directly coated on the titanium structural members, which are immersed in water or seawater as an anode. Thus, metallic members of a heat exchanger electrically connected to the titanium structural members, such as members of the water box and water tubes usually formed of steels and lined with rubber, are subject to anodic loading. Therefore, if a part of the rubber lining should be accidentally broken, a current flows through a part of the steel member corresponding to the broken part of the rubber lining and the steel member is corroded abnormally.

This known antifouling method subjects a structure having structural members coated with the film of the electrical catalyst to an electric resistance heating process to heat the component members at a temperature in the range of 350 to 450° C. for several hours to activate the electrical catalyst. Such a heating process is possible to damage the structure and costly and hence this known antifouling method has not been prevalently applied to practical uses.

Generally, only the heat transfer tubes and the tube plates of a titanium heat exchanger are formed of titanium, and the body, the water box, the supply pipes for carrying seawater to the heat exchanger, and the discharge pipes for discharging seawater into the sea are formed of steels. Since the steel water box, the steel seawater supply pipes and the steel discharge pipes are electrically connected to the titanium members, those steel members are subject to galvanic corrosion when immersed in seawater and are corroded intensely. Therefore, the surfaces to be exposed to seawater of those steel members are coated with rubber linings to protect the same from corrosion.

If the rubber lining coating the steel member should be broken, the titanium member electrically connected to the steel member must be loaded at a cathodic potential by a cathodic protection method which reduces the potential of the steel member to a protective potential. However, since the cathodic protection method uses the titanium member as an anode, the steel water box, the steel supply tubes and steel discharge tubes electrically connected to the titanium member are loaded at a cathodic potential. Consequently, it is theoretically impossible to use the cathodic protection method, and an electric current flows through a part of the steel member corresponding to a broken part of the rubber lining to cause the abnormal corrosion of the steel part.

Japanese patent laid-open publication No. P2000-119884A (Kokai) discloses an antifouling system that generates oxygen on the surfaces to be wetted with seawater of a structure exposed to seawater to suppress the adhesion of marine organisms to the surfaces exposed to seawater. In the antifouling system, a titanium sheet, on which the electrical catalyst is pre-coated, is used as an anode-forming member. The titanium sheet is fixed on a titanium tube plate, via an insulating adhesive layer. A conductive member disposed on a rubber lining coating a wall of a water box (usually made of steel) of the heat exchanger. A positive electrode of a dc power unit is connected to the anode-forming member or the electrical catalyst, and a negative electrode of the dc power unit is connected to the conductive member. The dc power unit is internally provided with an automatic potential controller that adjusts potential difference between the positive and the negative electrode such that oxygen is generated while generation of chlorine in seawater is suppressed.

In the above system, since a titanium sheet is provided with the pre-coated electrical catalyst, such titanium sheet can be easily bonded to the surface of the titanium tube plate at an ordinary temperature using the insulating adhesive. Thus, any destructive thermal stress will not be induced in the components and the assembled structure of the heat exchanger. In addition, the anode-forming member is electrically insulated from a structural member, such as a titanium tube plate, by the insulating adhesive. Thus, even if a rubber lining coating the steel member is broken accidentally, the abnormal corrosion of the steel member electrically connected to the titanium tube plate (e.g., a wall of a water box of the heat exchanger) can be prevented. This is because a cathodic protection current is supplied to the metallic member by the dc power unit.

The antifouling system disclosed in P2000-119884A is very effective when the heat exchanger is provided with highly corrosion-resistant titanium heat transfer tubes which do not need to be protected by the cathodic protection method. However, when the heat exchanger is provided with heat transfer tubes formed of an aluminum brass inferior to titanium in corrosion resistance and needing protection from corrosion by the cathodic protection method, the control of a current that flows through the antifouling system, i.e., the control of the potential difference, is difficult and it is possible that the antifouling effect of the antifouling system is reduced. This is because a cathodic protection current that flows through the aluminum brass heat transfer tubes and an antifouling current that flows through the conductive member interfere with each other.

The performance of this antifouling system will be more specifically described on the basis of numerical values. Suppose that an antifouling current density necessary to maintain the anode-forming member attached to a tube plate of a heat exchanger at a potential of 1.0 V to generate oxygen is 0.5 $A/m^2$. The tube plate of a heat exchanger for a 1000-MW power plant has an area of about 18 $m^2$ and an antifouling current that flows from the tube plate into seawater is about 3 A. An anticorrosion current necessary for the cathodic protection of the aluminum brass tubes (current that flows toward the tube plate, i.e., a current that flows through the aluminum brass tubes) is on the order of 60 A, which is about twenty times the antifouling current of about 3 A. Whereas the control of the high cathodic protection current is easy, the control of the low antifouling current, which is about 1/20 of the cathodic protection current, is difficult when those currents flow in opposite directions, respectively, in seawater contained in the water box and hence the antifouling effect cannot be properly maintained.

In some cases, the water box and the pipes electrically connected to the heat transfer tubes must be protected by a cathodic protection method even if the heat exchanger is provided with titanium heat transfer tubes which does not need to be protected by a cathodic protection method. In such a case, the interference between the antifouling current and the cathodic protection current causes a problem.

SUMMARY OF THE INVENTION

The present invention has been made to solve the aforesaid problems and it is therefore an object of the present invention to provide an antifouling system for a heat exchanger, capable of preventing the interference between an antifouling current and a cathodic protection current, and of surely and easily achieving the control of the antifouling current, i.e., the control of potential.

According to the first aspect of the present invention, an antifouling system for protecting a structure exposed to seawater from fouling is provided. The antifouling system includes: an anode-forming member arranged on a surface of a member, which is to be protected from fouling, of the structure via an insulating member; an electrical catalyst of an electrochemically active, stable material coating the anode-forming member; a dc power unit having: a positive electrode connected to the anode-forming member or the electrical catalyst; a negative electrode connected to a metallic member forming at least part of the structure and wetted with seawater; and an automatic potential controller that adjusts potential difference between the positive and the negative electrode such that oxygen is generated while generation of chlorine in seawater is suppressed; and a cathodic protection current supply system that supplies a cathodic protection current to the metallic member wetted with seawater and forming at least part of the structure.

According to the second aspect of the present invention, an antifouling system for protecting a heat exchanger including a plurality of heat transfer tubes formed of a metal, and a tube plate formed of a metal and supporting the heat transfer tubes, is provided. The antifouling system includes: an anode-forming member arranged on a surface of a member, which is to be protected from fouling, of the heat exchanger via an insulating member; an electrical catalyst of an electrochemically active, stable material coating the anode-forming member; an electrical catalyst of an electrochemically active, stable material coating the anode-forming member; a dc power unit having: a positive electrode connected to the anode-forming member or the electrical catalyst film; a negative electrode electrically connected to the heat transfer tubes of the heat exchanger; and an automatic potential controller that adjusts potential difference between the positive and the negative electrode such that oxygen is generated while generation of chlorine in seawater is suppressed; and a cathodic protection current supply system that supplies a cathodic protection current to the heat transfer tubes, or to a component member of the heat exchanger, the component member being wetted with seawater and electrically connected to the heat transfer tubes, wherein inner surfaces of the heat transfer tubes are used as a cathode for electrolysis for oxygen generation.

BRIEF DESCRIPTION OF THE DRAWINGS

The above and other objects, features and advantages of the present invention will become more apparent form the following description taken in connection with the accompanying drawings, in which.

DESCRIPTION OF THE PREFERRED EMBODIMENTS

Figure 1:
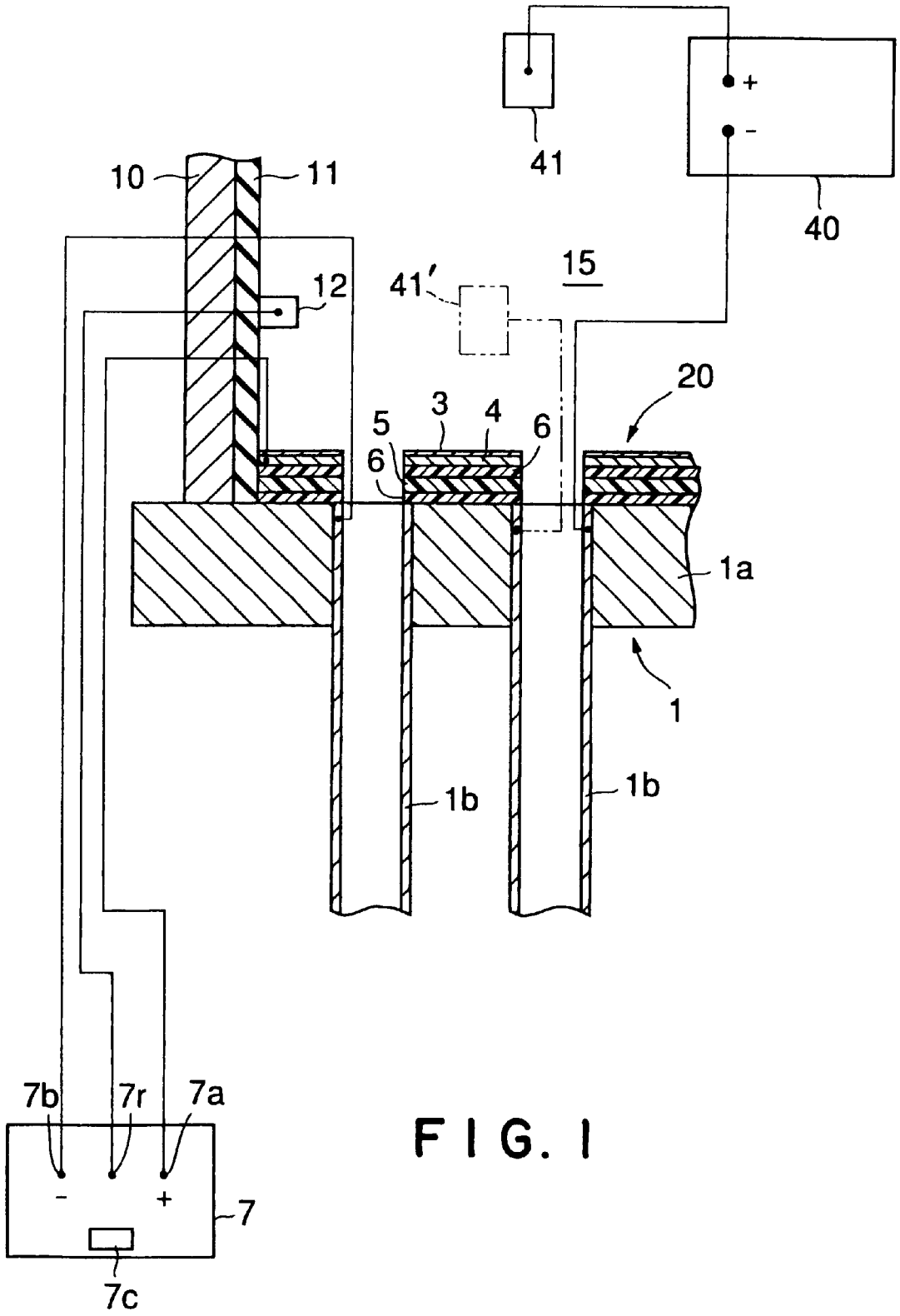
FIG. 1 is a schematic sectional view of an antifouling system in a first embodiment according to the present invention.

Preferred embodiments according to the present invention will be described hereinafter with reference to the accompanying drawings. Referring to FIG. 1 showing an antifouling system 20 in a first embodiment according to the present invention for a heat exchanger 1 in a schematic sectional view, the heat exchanger 1 includes a plurality of heat transfer tubes 1*b* formed of an aluminum brass, and a tube plate 1*a* formed of a naval brass supporting those heat transfer tubes 1*b*. The antifouling system is intended to prevent the fouling of an outer surface on the side of seawater 15 of the tube plate 1*a*. The heat exchanger 1 is provided with a water box 10 on the side of seawater 15. The inner surfaces of walls forming the water box 10 are coated with a rubber lining 11.

The antifouling system 20 has an insulating sheet 5. The insulating sheet 5 is bonded to the outer surface of the tube plate 1*a* with an insulating adhesive resin layer 6. A titanium sheet 4, i.e., anode-forming member, of a thickness in the range of 0.1 to 0.3 mm is bonded to the upper surface of the insulating sheet 5 with an insulating adhesive resin layer 6 so as to cover the upper surface substantially entirely.

An electrochemically active, stable electrical catalyst film 3 is formed on the upper surface of the titanium sheet 4 by applying an electrical catalyst in a film to a surface of the titanium sheet 4 and heating the titanium sheet 4 having the surface coated with the film of the electrical catalyst at a temperature in the range of 350 to 450° C. for several hours by a heating process using resistance heating. Formation of the electrical catalyst film 3 is carried out prior to adhesive-bonding of the titanium sheet 4 to the insulating sheet 5. The electrical catalyst forming the electrical catalyst film 3 is a metal of a platinum group metal, an oxide of a platinum group metal, cobalt oxide, manganese dioxide, or a mixed crystal or a composite of cobalt oxide and manganese dioxide.

The insulating adhesive layer 6 is formed of an elastic adhesive containing, as principal components, an epoxy resin, an epoxy-amine resin and a modified silicone polymer. This adhesive has high insulating strength and exerts stable adhesive strength in seawater of temperatures in the range of 0 to 50° C. The insulating sheet 5 is excellent in seawater resistance and is a sheet that is not deteriorated by seawater, such as a vinyl chloride sheet or a fiber-reinforced plastic sheet.

As shown in FIG. 1, the titanium sheet 4 and the insulating sheet 5 are provided with a plurality of openings respectively coinciding with the heat transfer pipes 1*b*, and having a diameter equal to the inside diameter of the heat transfer pipes 1*b*.

A reference electrode 12 projects from a part near the titanium sheet 4 of a sidewall of the water box 10, and extends above the titanium sheet 4.

The antifouling system 20 is provided with an external dc power unit 7 having a positive electrode 7*a* electrically connected to the titanium sheet 4, i.e., an anode-forming member, a negative electrode 7*b* electrically connected to the heat transfer pipes 1*b*, i.e., conductive members, and a reference electrode 7*r* electrically connected to the reference electrode 12.

The dc power unit 7 is internally provided with an automatic potential controller 7*c* to control the potential difference between the positive electrode 7*a* and the negative electrode 7*b* such that the generation of chlorine in seawater 15 is suppressed and oxygen is generated in seawater 15. More specifically, a proper potential difference between the positive electrode 7*a* and the negative electrode 7*b* is lower than a SCE reference voltage of 1.20 V at which seawater is electrolyzed to generate chlorine and higher than an oxygen generating voltage of 0.52 V at which oxygen is generated in standard seawater. The reference electrode 12 monitors the potential of the titanium sheet 4, and the automatic potential controller 7*c* controls the potential difference between the positive electrode 7*a* and the negative electrode 7*b* on the basis of data provided by the reference electrode 12.

The heat transfer tubes 1*b* formed of the aluminum brass is inferior in resistance to the corrosive action of seawater and hence the same are protected from corrosion by a cathodic protection method. The cathodic protection method may be of either an external power supply system or a sacrificial anode system. The antifouling system 20 shown in FIG. 1 employs a cathodic protection method of an external power supply system. The heat transfer tubes 1*b* are connected electrically through an external dc power unit 40 for cathodic protection to a cathodic protection electrode 41. A cathodic protection current flows from the cathodic protection electrode 41 into the heat transfer tubes 1*b*.

In the event that sacrificial anode system is used for the cathodic protection method, as indicated by chain lines in FIG. 1, a sacrificial anode 41' is electrically connected to the heat transfer tubes 1*b* instead of the dc power unit 40 and electrode 41.

In the first embodiment, the heat transfer tubes 1*b* are connected to the negative electrode 7*b* of the dc power unit 7 to use the inner surfaces of the heat transfer tubes 1*b* as cathodes for seawater electrolysis. Thus, an antifouling current and a cathodic protection current flow in the same direction. Therefore, interference between the antifouling current and the cathodic protection current is negligible, and the control of the antifouling current for potential control can be surely and easily achieved. Thus, the dc power unit 7 is able to hold the potential of the titanium sheet 4, i.e., the potential of the electrical catalyst film 3, easily in the range of 0.52 to 1.20 V. Consequently, the generation of chlorine on the surface of the electrical catalyst film 3 can be suppressed and oxygen can be generated to prevent marine organisms from attaching themselves to the surface of the electrical catalyst film 3.

Since the titanium sheet 4 coated beforehand with the electrical catalyst film 3 is bonded with the insulating adhesive resin layer 6 to the insulating sheet 5 bonded to the tube plate 1*a*, the titanium sheet 4 can be easily bonded to the insulating sheet 5 at an ordinary temperature, and hence destructive thermal stress, which is induced in the heat exchanger 1 if the electrical catalyst film 3 is subject to a thermal activation process after being attached to the heat exchanger 1, will not be induced in the heat exchanger 1.

Since the insulating adhesive resin layers 6 and the insulating sheet 5 are interposed between the titanium sheet 4 and the surface on the side of seawater 15 of the tube plate 1*a*, the tube plate 1*a* and the titanium sheet 4 are electrically insulated and the abnormal corrosion of metal members electrically connected to the tube plate 1*a* can be prevented.

The insulating adhesive resin layers 6 formed of an elastic adhesive containing, as principal components, an epoxy resin, an epoxy-amine resin and a modified silicone polymer, and having stable adhesive strength in seawater of temperatures in the range of 0 to 50° C. exert stable, durable adhesive strength. The elastic insulating adhesive resin layers 6 is effective in enhancing the durability of the electrical catalyst film 3 and the titanium sheet 4 with which foreign matters collide.

The vinyl chloride sheet or the fiber-reinforced plastic sheet serving as the insulating sheet 5 is excellent in corrosion resistance in seawater, resistant to degradation and highly workable. The openings coinciding with the heat transfer tubes 1*b* can be easily formed in the insulating sheet 5. The openings can be easily formed in both the titanium sheet 4 and the insulating sheet 5 after bonding together the titanium sheet 4 and the insulating sheet 5 with the insulating adhesive resin layer 6.

The reference electrode 12 disposed near the titanium sheet 4, i.e., the anode-forming member, is able to monitor the potential of the titanium sheet 4 accurately to ensure accurate potential control.

Figure 2:
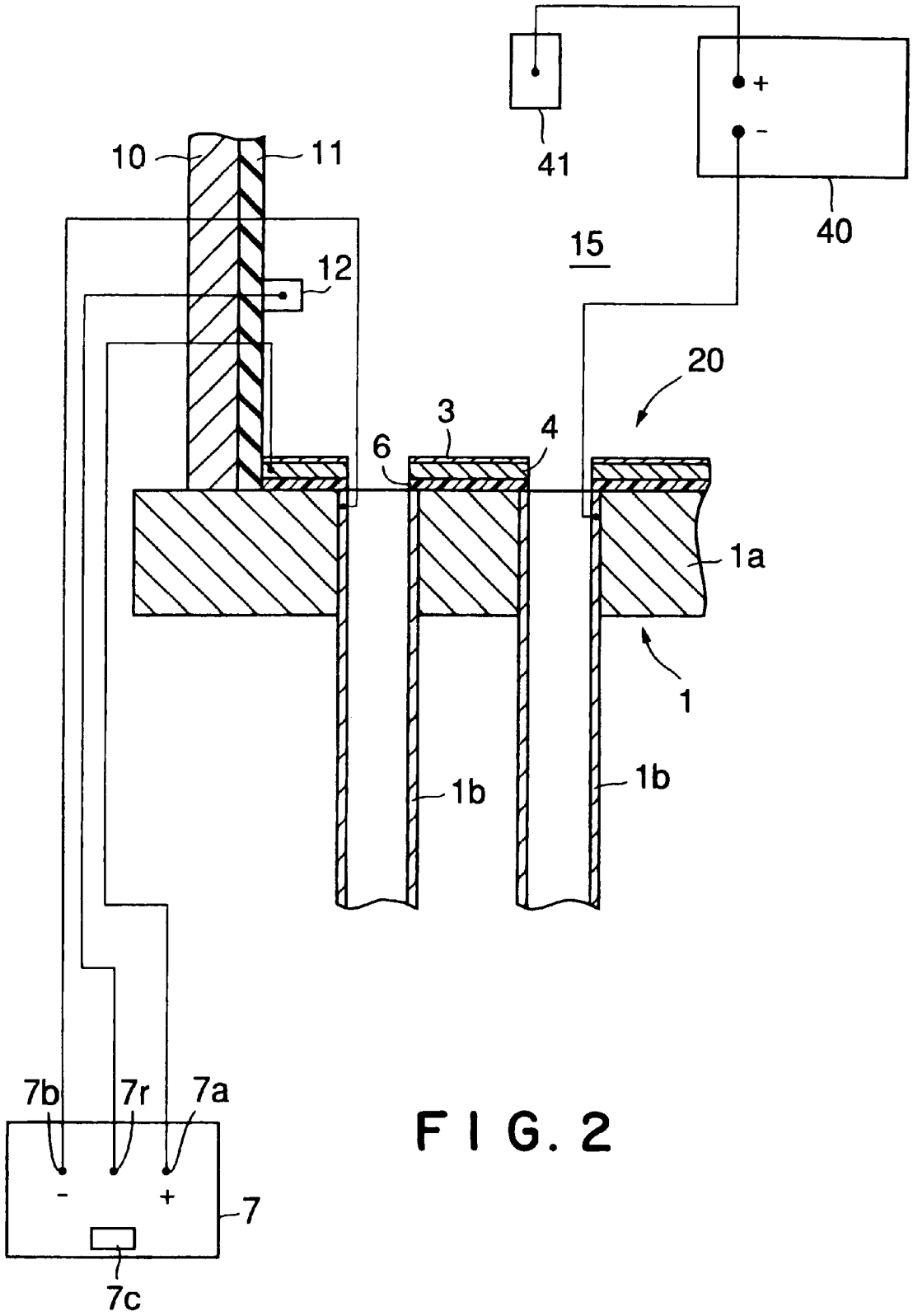
FIG. 2 is a schematic sectional view of a first modification of the antifouling system shown in FIG. 1.

If the insulating performance of the insulating adhesive resin layer 6 is satisfactory, the insulating sheet 5 may be omitted. As shown in FIG. 2, the titanium sheet 4 may be directly bonded to the tube plate 1*a* with the insulating adhesive resin layer 6 without using the insulating sheet 5.

Figure 3:
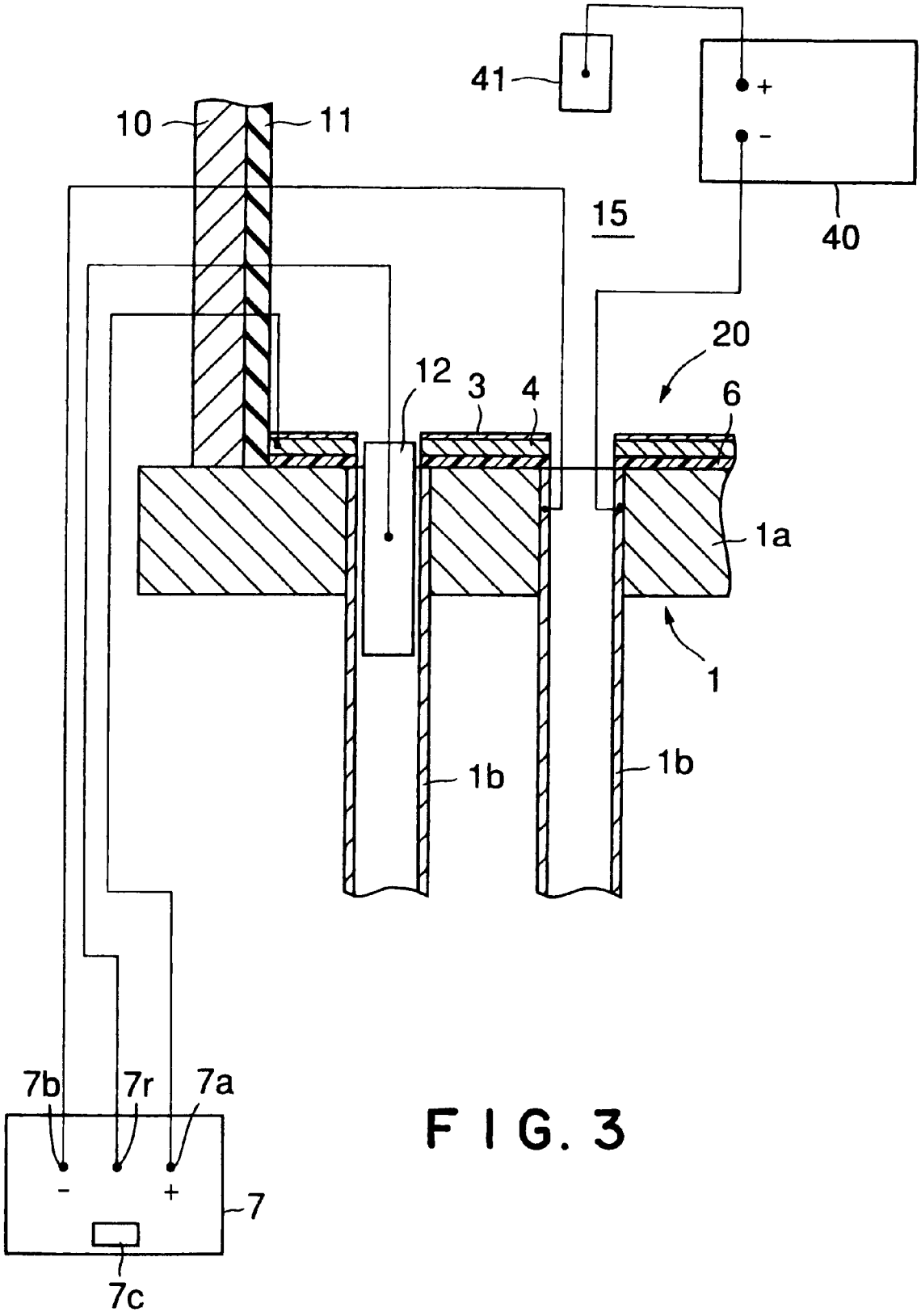
FIG. 3 is a schematic sectional view of a second modification of the antifouling system shown in FIG. 1.

The position of the reference electrode 12 is not limited to that shown in FIG. 1. For example, the reference electrode 12 may be inserted in the heat transfer tube 1*b* so as to project into seawater 15 as shown in FIG. 3. When the reference electrode 12 is inserted in the heat transfer tube 1*b* as shown in FIG. 3, the reference electrode 12 is closer to the titanium sheet 4, i.e., the anode-forming member, and hence more accurate potential control is possible.

Figure 4:
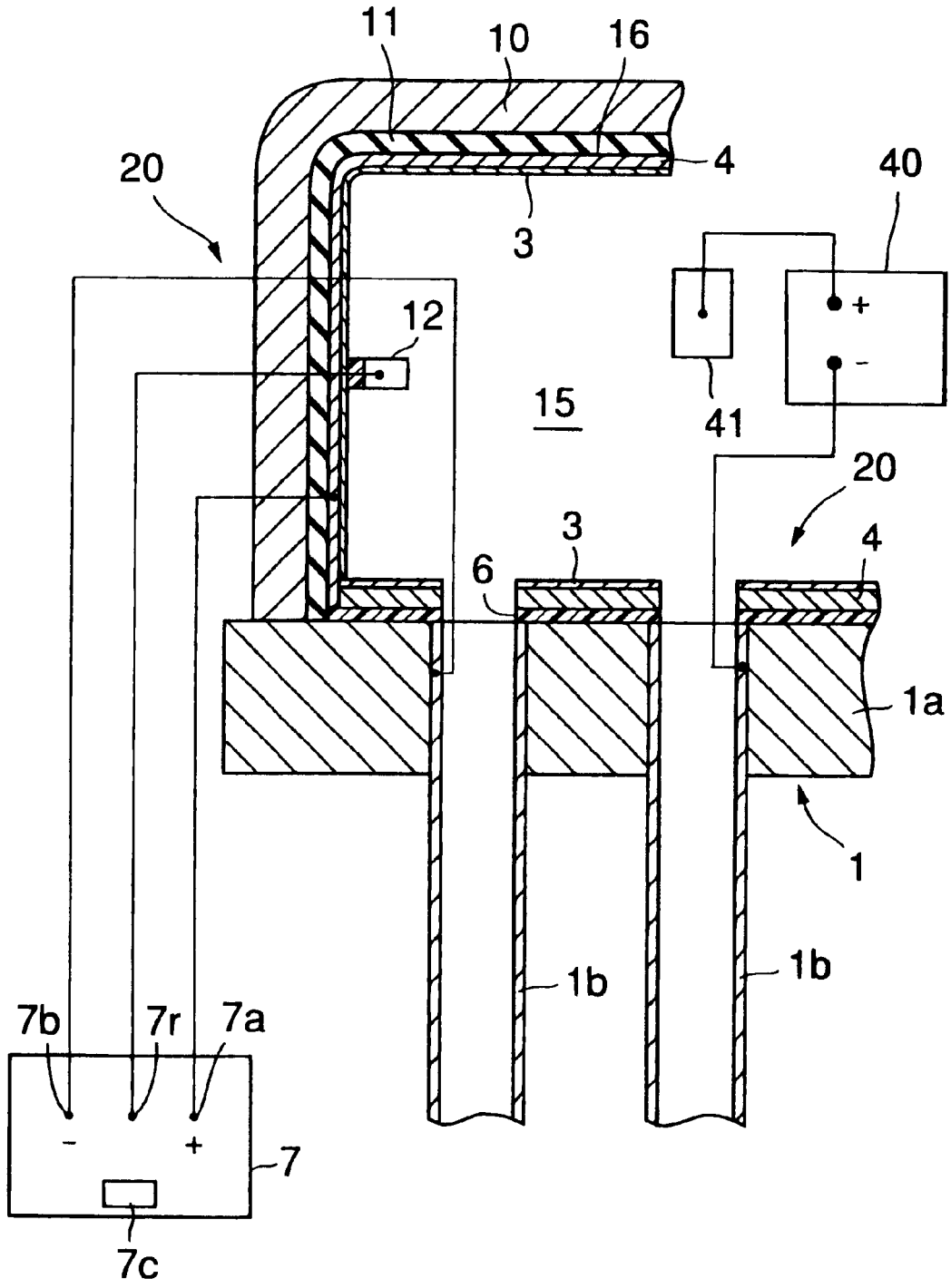
FIG. 4 is a schematic sectional view of a third modification of the antifouling system shown in FIG. 1.

The titanium sheet 4 coated with the electrical catalyst film 3 may be bonded to the surface of the rubber lining 11 covering the surfaces on the side of seawater 15 of the walls of the water box 10 with an adhesive resin layer 16 as shown in FIG. 4, and oxygen may be generated on the surface of the electrical catalyst film 3, suppressing the generation of chlorine. The adhesive resin layer 16 does not need to be insulating.

Figure 5:
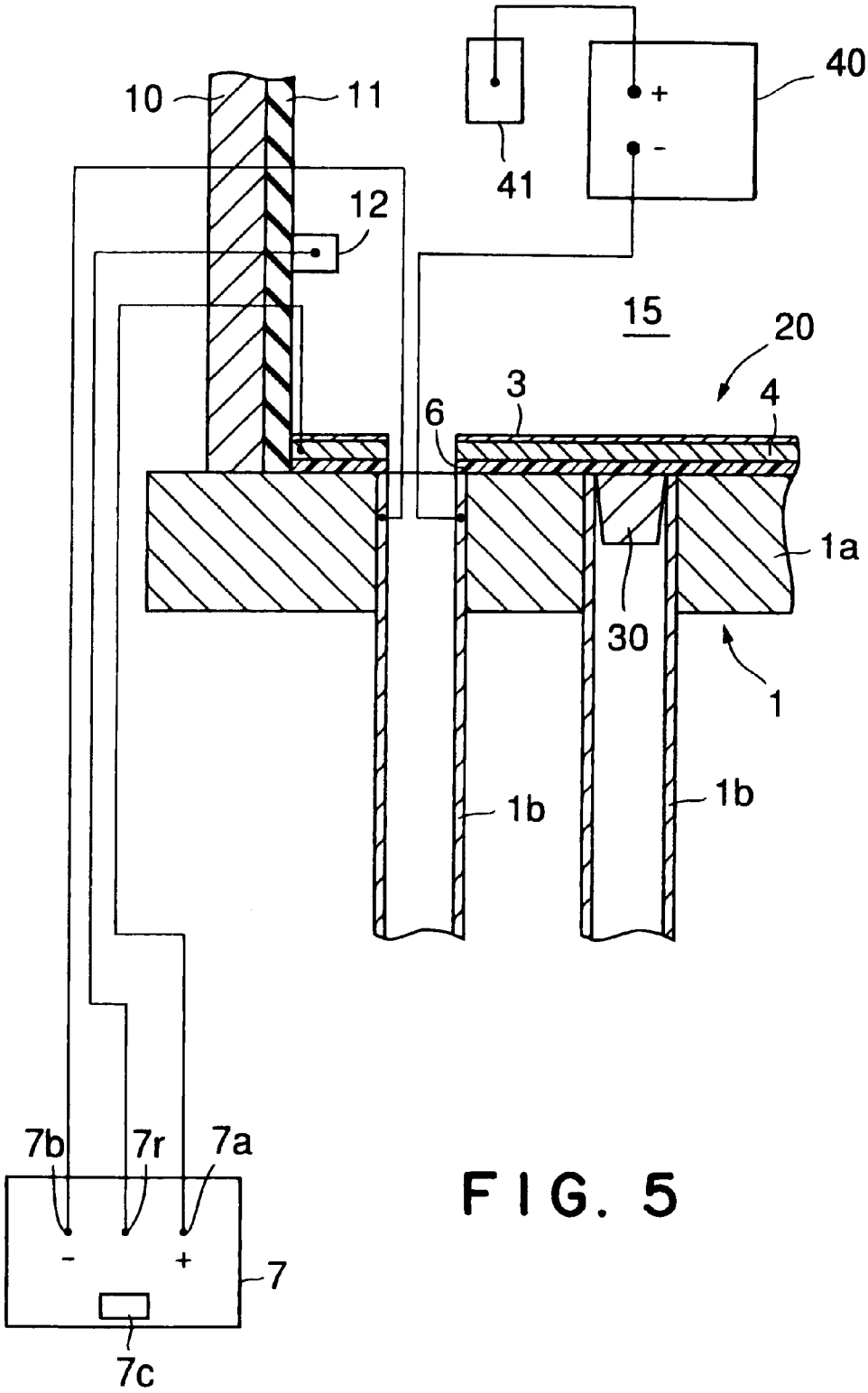
FIG. 5 is a schematic sectional view of an antifouling system in a second embodiment according to the present invention.

An antifouling system 20 in a second embodiment according to the present invention will be described with reference to FIG. 5, in which parts like or corresponding to those of the antifouling system in the first embodiment are denoted by the same reference characters and the description thereof will be omitted to avoid duplication.

The antifouling system 20 in the second embodiment for a heat exchanger has plugs 30 fitted respectively in end parts of some of heat transfer tubes 1*b* of the heat exchanger. The outer end surface on the side of seawater 15 of the plug 30 is substantially flush with the outer surface of a tube plate 1*a*. Preferably, the plugs 30 are made of the same material as the heat transfer tubes 1*b* in view of preventing galvanic corrosion in seawater.

A titanium sheet 4 is provided with openings of a diameter equal to the inside diameter of the heat transfer tubes 1*b* only at positions corresponding to the heat transfer tubes 1*b* excluding those provided with the plugs 30.

The titanium sheet 4 is bonded to outer surface of the tube plate 1*a* and the outer end surfaces of the plugs 30 with an insulating adhesive resin layer 6. A thus increased bonding area further stabilizes the adhesion of the titanium sheet 4 to the tube plate 1*a*.

Although the adhesion of the titanium sheet 4 to the tube plate 1*a* increases when the number of the plugs 30 is increased, it is desirable that the number of the plugs 30 is not greater than 3% of the number of the heat transfer tubes 1*b* because the heat exchanging efficiency of the heat exchanger reduces with the increase of the number of the plugged heat transfer tubes 1*b*.

Figure 6:
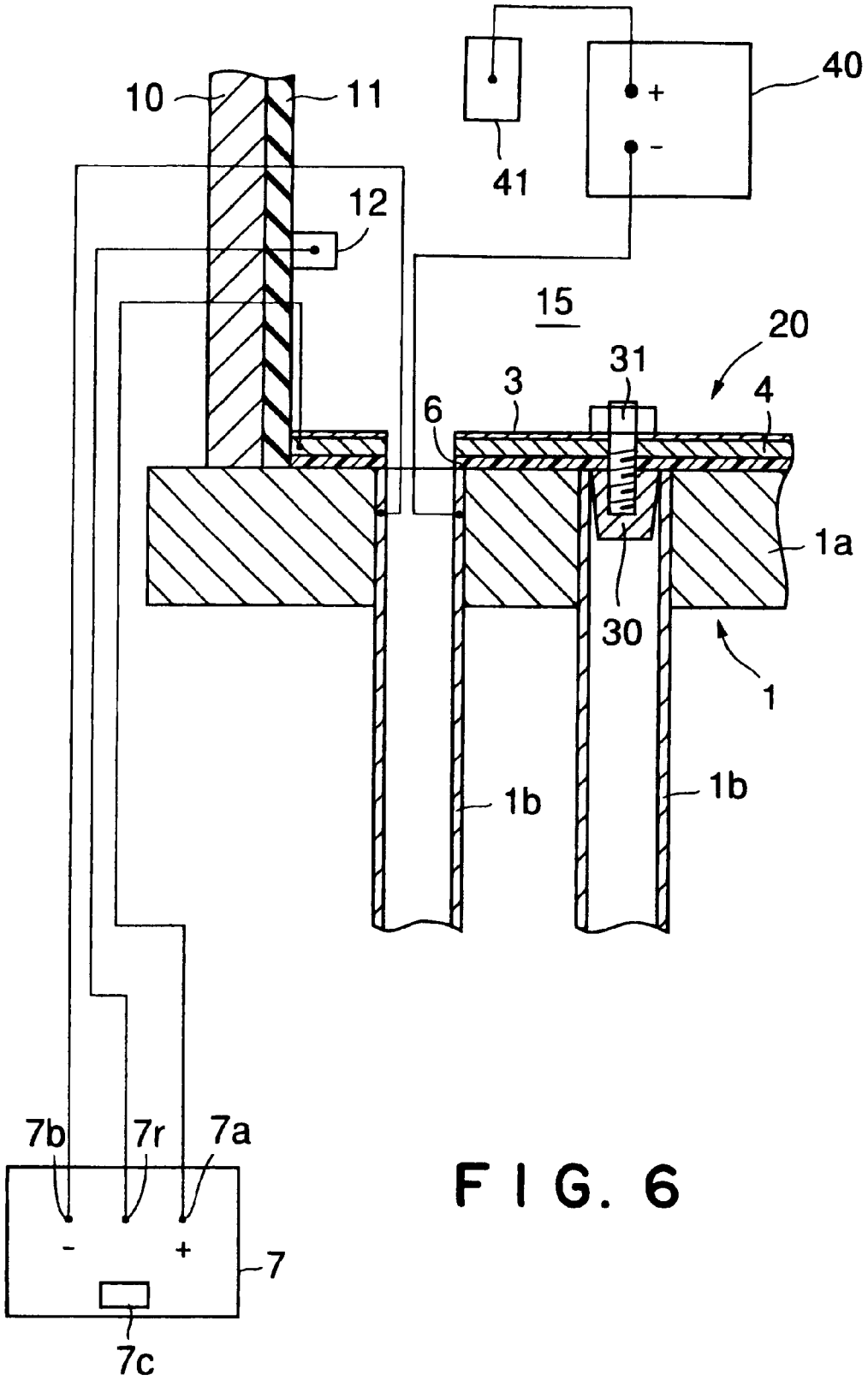
FIG. 6 is a sectional view of a first modification of the antifouling system shown in FIG. 5.

The titanium sheet 4 may be fastened to the plugs 30 with insulating bolts 31 as shown in FIG. 6. The insulating bolts 31 may be formed of an insulating material, such as a resin or a ceramic material, or may be formed of a metal and coated with an insulating film. When the titanium sheet 4 is thus fastened to the plugs 30 with the insulating bolts 31, the titanium sheet 4 can be firmly fastened to the tube plate 1*a* and the number of the plugged heat transfer tubes 1*b* can be reduced. The titanium sheet 4 may be fastened to the tube plate 1*a* with insulating bolts 31.

Although the heat transfer tubes 1*b* are formed of the aluminum brass and the tube plate 1*a* is formed of the naval brass in each of the antifouling systems shown in FIGS. 1 to 6, the heat transfer tubes 1*b* and the tube plate 1*a* may be formed of other materials. For example, the heat transfer tubes 1*b* may be formed of an aluminum brass and the tube plate 1*a* may be formed of an aluminum bronze; the heat transfer tubes 1*b* may be formed of a so-called super stainless steel and the tube plate 1*a* may be formed of a naval brass; the heat transfer tubes 1*b* may be formed of a super stainless steel and the tube plate 1*a* may be formed of an aluminum bronze; or the heat transfer tubes 1*b* and the tube plate 1*a* may be formed of a super stainless steel.

Both the heat transfer tubes 1*b* and the tube plate 1*a* may be formed of titanium. Since titanium is highly corrosion-resistant, the heat transfer tubes 1*b* and the tube plate 1*a* do not need cathodic protection. However, in some cases, the cathodic protection method is applied to other component members of the heat exchanger, such as the water box and pipes, connected to the heat transfer tubes 1*b* or the tube plate 1*a*. In such a case, it is possible that the antifouling current and the cathodic protection current interfere with each other and hence application of the present invention is effective.

Although the antifouling systems according to the present invention has been described as applied to the component members of the heat exchanger, the present invention is not limited thereto in its practical application and is applicable to all kinds of structures exposed to seawater and having problems relating to interference between the antifouling current and the cathodic protection current.

As apparent from the foregoing description, the antifouling system of the present invention, prevents interference between the antifouling current and the cathodic protection current effectively, and controls the antifouling current and the potentials of the component members with reliability.

Although the invention has been described in its preferred embodiments with a certain degree of particularity, obviously many changes and variations are possible therein. It is therefore to be understood that the present invention may be practiced otherwise than as specifically described herein without departing from the scope and spirit.

What is claimed is:

1. An antifouling system for protecting a structure exposed to seawater from fouling, said system comprising:

an anode-forming member arranged on a surface of a member, which is to be protected from fouling, of the structure via an insulating member;

an electrical catalyst of an electrochemically active, stable material coating the anode-forming member;

a dc power unit having:

a positive electrode connected to the anode-forming member or the electrical catalyst;

a negative electrode connected to a metallic member forming at least part of the structure and wetted with seawater; and an automatic potential controller that adjusts potential difference between the positive and the negative electrode such that oxygen is generated while generation of chlorine in seawater is suppressed; and a cathodic protection current supply system that supplies a cathodic protection current to the metallic member wetted with seawater and forming at least part of the structure.

2. The antifouling system according to claim 1, wherein the cathodic protection current supply system comprises a dc power unit having a positive electrode connected to a cathodic protection electrode wetted with seawater and a negative electrode connected to the metallic member.

3. The antifouling system according to claim 1, wherein the cathodic protection current supply system comprises a sacrificial anode.

4. An antifouling system for protecting a heat exchanger including a plurality of heat transfer tubes formed of a metal, and a tube plate formed of a metal and supporting the heat transfer tubes, said system comprising:

an anode-forming member arranged on a surface of a member, which is to be protected from fouling, of the heat exchanger via an insulating member;

an electrical catalyst of an electrochemically active, stable material coating the anode-forming member;

an electrical catalyst of an electrochemically active, stable material coating the anode-forming member;

a dc power unit having:

a positive electrode connected to the anode-forming member or the electrical catalyst film;

a negative electrode electrically connected to the heat transfer tubes of the heat exchanger; and an automatic potential controller that adjusts potential difference between the positive and the negative electrode such that oxygen is generated while generation of chlorine in seawater is suppressed; and a cathodic protection current supply system that supplies a cathodic protection current to the heat transfer tubes, or to a component member of the heat exchanger, the component member being wetted with seawater and electrically connected to the heat transfer tubes, wherein inner surfaces of the heat transfer tubes are used as a cathode for electrolysis for oxygen generation.

5. The antifouling system according to claim 4, wherein the cathodic protection current supply system comprises a dc power unit having a positive electrode connected to a cathodic protection electrode wetted with seawater and a negative electrode connected to the metallic member.

6. The antifouling system according to claim 5, wherein:

plugs are fitted in end parts of some of the plurality of heat transfer tubes;

the anode-forming member is provided with openings in parts thereof coinciding with open ends of the heat transfer tubes in which plugs are not fitted, and is not provided with any openings in parts thereof coinciding with the closed ends of the heat transfer tubes in which the plugs are fitted; and the anode-forming member is bonded to an outer surface of the tube plate and end surfaces of the plugs with an insulating adhesive layer acting as the insulating member.

7. The antifouling system according to claim 6, wherein the parts of the anode-forming member coinciding with the plugs are fastened to the plugs with an insulating bolts.

8. The antifouling system according to claim 4, wherein the cathodic protection current supply system comprises a sacrificial anode.

9. The antifouling system according to claim 4, wherein the member to be protected from fouling is the tube plate of the heat exchanger.

10. The antifouling system according to claim 4, wherein the member be protected from fouling is an inner surface of a wall forming a water box of the heat exchanger, the inner surface is coated with a lining of rubber or a resin, and the anode-forming member is arranged on the lining, which acts as the insulating member.

11. The antifouling system according to claim 4, wherein a seawater-corrosion-resistant insulating sheet of vinyl chloride or a seawater-corrosion-resistant fiber-reinforced plastic sheet, acting as the insulating member, is arranged between the member be protected from fouling and the anode-forming member.

12. The antifouling system according to claim 4, wherein the anode-forming member is bonded to the member to be protected from fouling with an insulating adhesive layer acting as the insulating member.

* * * * *